US005535107A

United States Patent [19]

Prok

[11] Patent Number: 5,535,107

[45] Date of Patent: Jul. 9, 1996

[54] COMBINATION GAS RECOMBINATION/VENTING MEANS FOR PORTABLE LIGHTING DEVICE

[75] Inventor: Robert A. Prok, Columbia Station, Ohio

[73] Assignee: Eveready Battery Company, Inc., St. Louis, Mo.

[21] Appl. No.: 359,594

[22] Filed: Dec. 20, 1994

[51] Int. Cl.[6] ..... F21L 7/00

[52] U.S. Cl. ..... 362/158; 362/267; 362/294

[58] Field of Search ..... 362/267, 158, 362/294; 220/203.01, 202, 203.29, 303, 366.1, 367.1

[56] References Cited

U.S. PATENT DOCUMENTS

| | | | |
|---|---|---|---|
| 2,743,841 | 5/1956 | Bügel | 220/203.29 |
| 3,798,440 | 3/1974 | Brindley | 362/158 |
| 3,939,006 | 2/1976 | Kozawa | 429/57 |
| 4,237,526 | 12/1980 | Wood | 362/158 |
| 4,626,852 | 12/1986 | Dodge | 340/985 |
| 5,113,326 | 5/1992 | Maglica | 362/158 |
| 5,207,502 | 5/1993 | Maglica | 362/158 |
| 5,260,858 | 11/1993 | Maglica | 362/158 |
| 5,349,507 | 9/1994 | Parker | 362/158 |
| 5,404,281 | 4/1995 | Parker | 362/294 |

*Primary Examiner*—Denise L. Gromada
*Assistant Examiner*—Sara Sachie Raab
*Attorney, Agent, or Firm*—Robert W. Welsh

[57] ABSTRACT

An electrochemically operated device such as a portable lantern, with a waterproof housing enclosing at least one galvanic battery cell which evolves hydrogen gas, and a push button switch in the housing, a shiftable boot exposed to the housing exterior and aligned on the interior with the switch, a hydrogen recombination pellet in the housing, and a pellet retainer retaining the pellet, the housing including an elastomeric septum between its interior and exterior, having a sphincter orifice therethrough of a size to be elastomerically squeezed closed except under a predetermined pressure differential thereacross, to thereby prevent water entry to the housing, but to open to allow hydrogen gas escape from the housing at a pressure differential across the septum. The boot is resilient and the elastomeric septum preferably forms a part of the boot.

10 Claims, 1 Drawing Sheet

COMBINATION GAS RECOMBINATION/VENTING MEANS FOR PORTABLE LIGHTING DEVICE

BACKGROUND OF THE INVENTION

This invention relates to waterproof electrochemical devices such as portable lighting devices, anti particularly to the type of such devices which have an electrochemical Cell that generates hydrogen gas.

Portable lighting devices such as lanterns and flashlights which employ batteries having aqueous electrolytes, e.g., alkaline $MnO_2$ batteries, must provide means for safely eliminating the hydrogen gas which is evolved from the batteries as a result of corrosion reactions, charging, cell reversal, etc. This becomes an even more serious problem in sealed, waterproof lighting devices where the trapped hydrogen gas can explosively react with available oxygen in the air inside the housing when detonated by external static electricity or an internal spark generated, e.g., by the switch operation. This can happen, for example, in vented units when a person who has generated static electricity on his or her body reaches out to a lantern of this type.

Various venting means have been used in the prior art, e.g., as taught in U.S. Pat. No. 4,626,852 to Pennwalt Corporation. Applicant's U.S. Pat. No. 4,237,526 covers a waterproof lighting device having a gas vent opening covered with a hydrophobic membrane of microporosity sufficient to maintain the hydrogen concentration in the housing below 10 vol %. One-way vent valves have also been used (U.S. Pat. Nos. 5,207,502, 5,113,326 and 5,349,507).

Applicant's waterproof lanterns are currently made containing a small catalyst pellet (about 0.050 g) of palladium coated on an alumina ($Al_2O_3$) substrate for catalytic recombination of evolved hydrogen with the oxygen present in the housing. However, this pellet does not always seem to be as efficient as needed to prevent hydrogen detonations, as discussed, for example, in U.S. Pat. No. 5,349,507.

SUMMARY OF THE INVENTION

An object of this invention is to provide a waterproof electrochemical device such as a portable lighting device employing a battery of the hydrogen generation type, and capable of safely disposing of the hydrogen by a combination of hydrogen recombination and hydrogen venting, whereby initially generated hydrogen in the housing is recombined with oxygen in the housing, and any excess hydrogen over the stoichiometric amount is dissipated through a specially controlled sphincter-type vent passage to the exterior of the device, yet without sacrificing the waterproof characteristic of the device, so that the device meets Eveready Battery Company's waterproof test which is based on a standard waterproof test used by the Coast Guard and the military standards.

The combination herein greatly improves the safety of the sealed lantern or flashlight. A catalyst pellet of palladium mixed with a carbon substrate has been found to recombine hydrogen and oxygen more efficiently than the $Pd/Al_2O_3$ pellet. It is believed that the higher surface area of the carbon vs. $Al_2O_3$ contributes to the greater efficiency of the Pd/C pellet. This is used in combination with a very small, resiliently closed vent opening in an elastomeric septum, to remain closed except to relieve pressurized gas when all the oxygen has been consumed and additional hydrogen evolution occurs. Under such circumstances, without the vent opening, hydrogen buildup could still result in a sudden pressure release which could injure the consumer. Normally, a mixture of more than 75% hydrogen with oxygen is not combustible; however, rapid mixing of hydrogen with outside air upon a sudden pressure release and in the presence of an ignition source such as a static electricity spark could produce a combustible mixture. The vent opening in the elastomeric septum is a tiny hole in the flexible elastomeric member, e.g., in the poly(vinyl chloride) switch boot of the device. Such a small opening is formed by a pin or needle, to be of a diameter in the order of about 0.020 to 0.060 inch, preferably about 0.050 inch, when open, in the boot, which opening is resiliently closed in the nature of a sphincter except when passing gas. It will allow passage of gas under a pressure differential thereacross, preferably of about 1–3 psi, to relieve the internal pressure safely, yet otherwise be closed to retain waterproof characteristics of the device. It is waterproof at three feet underwater for 60 minutes without water ingress, meeting the standard waterproof test used by Eveready Battery Company. This combined recombination/vent assembly of the waterproof device eliminates pressure explosion of the lighting device as well as substantially minimizing the danger of combustion of the vented gas.

DESCRIPTION OF THE PREFERRED EMBODIMENT

Figure 1:
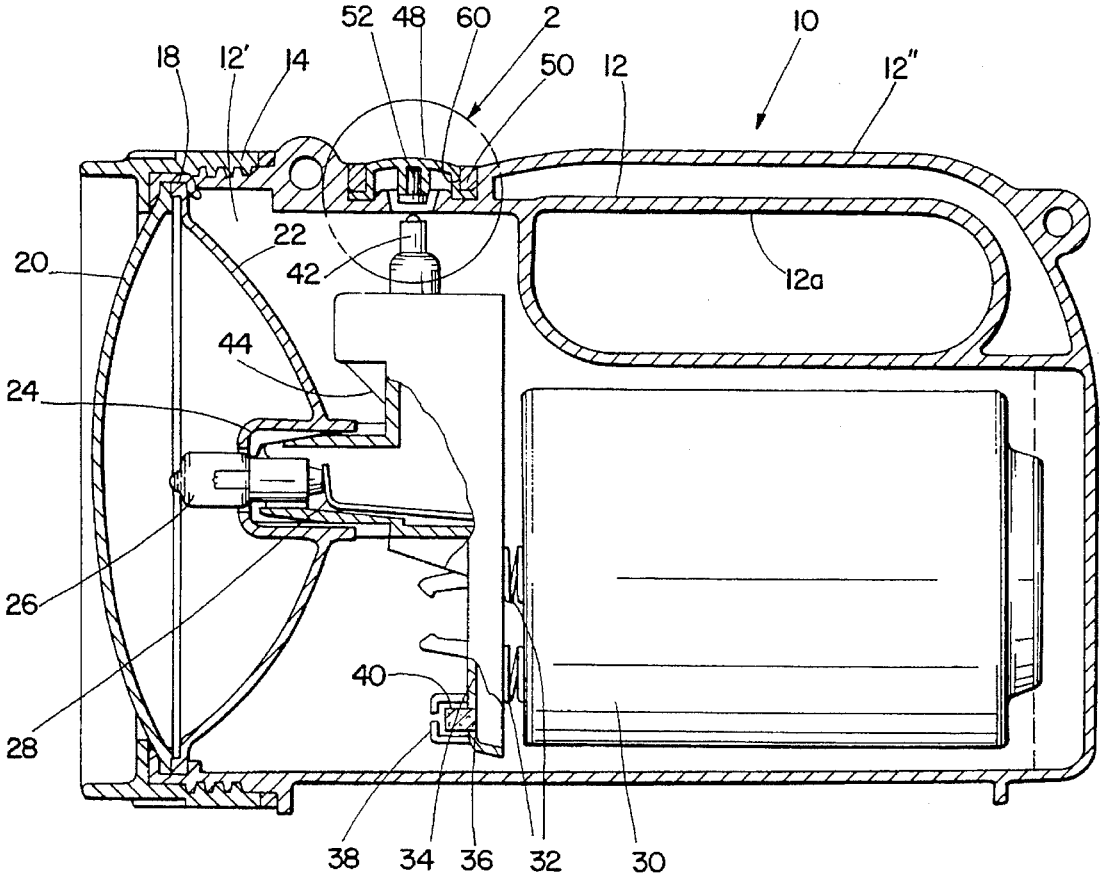
FIG. 1 is a side elevational sectional view of a portable lighting device, i.e., a lantern, employing the invention.
Figure 2:
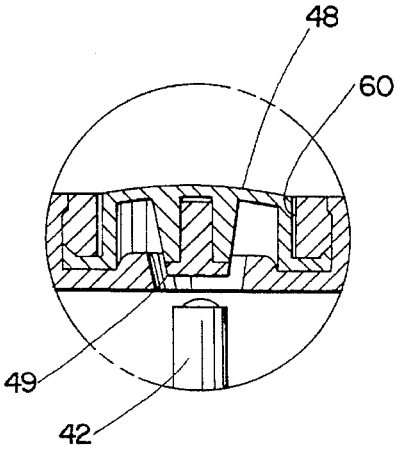
FIG. 2 is a fragmentary, enlarged, sectional view of the encircled area in FIG. 1.

Referring now specifically to the drawings, the device 10 there depicted is a typical form of a lantern including a lantern housing 12 which has an internal space 12' and an exterior 12". On the front end of the lantern housing is a peripheral lens ring 14 which seals to housing 12 by an annular, polymeric, compression seal ring or gasket 18 of generally L-shaped cross section between the lens 20 and lens ring 14. A reflector 22 of typical concave configuration is in the open front end of housing 12, held axially aligned with lens 20 by lens ring 14. In the center of reflector 22 is a lamp socket 24 containing a conventional incandescent bulb 26 and a lamp contact spring 28. A battery 30 of the type which generates hydrogen, e.g., an alkaline $MnO_2$ battery, is mounted in a battery chamber within housing 12. The battery has contacts 32 on one end thereof at contact holder 34 and metal contact plate 36.

Adjacent the contacts of the battery, e.g., on contact plate 36, is a pellet housing or retainer 38 containing a hydrogen recombination pellet 40. This recombination pellet is preferably a platinum or palladium material on a high surface area substrate such as carbon.

Commercially available gas recombination pellets containing a platinum group metal such as platinum or palladium mixed with a high surface area substrate such as carbon may be used. The type of gas recombination pellet described in U.S. Pat. No. 3,939,006 to Kozawa may also be used. This pellet employs a mixture of a catalyst such as Pd-catalyzed carbon and a solid compound such as $MnO_2$, $Mn_2O_3$, silver oxide, etc., which chemically reacts with the hydrogen gas.

Also mounted within housing 12 is a push button switch 42 and a switch-to-bulb contact 44 of conventional type.

Housing 12 includes a handle 12*a*. Adjacent this handle, in the housing itself, and axially aligned with push button switch 42, is a switch boot 48 over an opening 49. This boot is held in place in the housing by a boot retainer 50, and typically includes a central retainer for solid boot plug 52 in the center of the boot. This boot is relatively thin and made of a resilient material such as polyvinyl chloride. It is elastomeric in nature. Its outer periphery includes an annular flange engaging boot retainer 50. The resilient nature of the boot allows it to be depressed by thumb pressure of a person holding onto handle 12*a*, the boot then shifting inwardly toward the interior of the housing, with boot plug 52 engaging and depressing switch 42, to activate the light. The boot reverts to its at-rest position when released. The same movement will deactivate the light.

In the annular septum of the boot surrounding the central retainer for the boot plug, a tiny hole 60 is made. This can be clone with a pin or needle. The elastomeric nature of the polymer causes this hole or orifice to normally be retained closed in the manner of a sphincter except when forcefully opened under a predetermined pressure differential across the boot, i.e., from the interior to the exterior of the housing. This orifice is of a sufficiently small size, about 0.020 to 0.060, preferably 0.050, inch in diameter, so that it will normally be retained closed, but will flexibly open under a pressure differential, preferably of about 1–3 psi thereacross, to allow escape of excess gas from the interior of the housing. The gas pressure differential causes the elastomeric septum around the orifice to resiliently flex. This releases excess gas above the stoichiometric amount of hydrogen which reacts with oxygen of air within the housing, under the influence of the pellet. After the pressure differential is relieved, the sphincter orifice closes.

Therefore, when battery 30 normally generates hydrogen gas, the recombination pellet 40 will cause this hydrogen gas to initially recombine with oxygen in the air contained in the waterproof housing until the stoichiometric amount of hydrogen balances that of the oxygen. Excess hydrogen that may then build up within the housing, upon reaching the predetermined pressure differential across the boot, will cause orifice 60 in the septum to dilate and release this excess gas harmlessly into the atmosphere, and then reclose.

The septum formed by the annular portion of the boot may conceivably be in another portion of the housing, but preferably simply forms part of the switch boot as depicted in the preferred embodiment.

The combination provides a significant safety factor to prevent waterproof containers, such as lantern housings, from inadvertently exploding upon generation of excess hydrogen and in the presence of an ignition device such as a static electricity spark. The housing arrangement is still waterproof. It can be subjected to underwater immersion even at depths of up to three feet for times up to 60 minutes without water ingress, meeting Eveready Battery Company's waterproof test procedure. Therefore, the combination has optimum characteristics of being waterproof and yet safe even in the condition where the battery is generating hydrogen.

Conceivably certain minor variations may be made in the type of device described and illustrated by the preferred embodiment, without departing from the invention. Hence, the invention is not intended to be limited to the specific embodiment illustrated as preferred, but only by the scope of the appended claims and the reasonably equivalent structures to those defined therein.

The embodiments of the invention in which an exclusive property or privilege is claimed are defined as follows:

1. In an electrochemically operated device comprising a waterproof housing having an exterior and an interior enclosing at least one galvanic battery cell which evolves hydrogen gas, and a push button switch in said housing;

said housing having a shiftable boot exposed to said exterior and aligned on said interior with said switch;

a hydrogen recombination pellet in said housing, and a pellet retainer in said housing retaining said pellet;

said housing including an elastomeric septum between said interior and said exterior, said septum having a sphincter orifice therethrough of a size that said orifice is elastomerically squeezed closed except under a predetermined pressure differential thereacross, to thereby prevent water entry to said housing, but temporarily open to allow hydrogen gas escape from said housing at a pressure differential across said septum.

2. The device in claim 1 comprising a portable lighting device.

3. In an electrochemically operated device comprising a waterproof housing having an exterior and an interior enclosing at least one galvanic battery cell which evolves hydrogen gas, and a push button switch in said housing:

said housing having a shiftable boot exposed to said exterior and aligned on said interior with said switch;

a hydrogen recombination pellet in said housing, and a pellet retainer in said housing retaining said pellet;

said housing including an elastomeric septum between said interior and said exterior, said septum having a sphincter orifice therethrough of a size that said orifice is elastomerically squeezed closed except under a predetermined pressure differential thereacross, to thereby prevent water entry to said housing, but temporarily open to allow hydrogen gas escape from said housing at a pressure differential across said septum;

said boot being resilient and said elastomeric septum forming a part of said boot.

4. The device in claim 3 wherein said boot is of resilient elastomeric polymer.

5. The device in claim 4 wherein said boot is of poly(vinyl chloride).

6. The device in claim 1 wherein said housing prevents water entry under conditions of immersion in three feet of water for 60 minutes.

7. The device of claim 1 wherein said predetermined pressure differential is 1–3 psi.

8. The device in claim 3 wherein said pellet comprises palladium on a carbon substrate.

9. In an electrochemically operated device comprising a waterproof housing having an exterior and an interior enclosing at least one galvanic battery cell which evolves hydrogen gas, and a push button switch in said housing:

said housing having a shiftable boot exposed to said exterior and aligned on said interior with said switch;

a hydrogen recombination pellet in said housing, and a pellet retainer in said housing retaining said pellet;

said housing including an elastomeric septum between said interior and said exterior, said septum having a sphincter orifice therethrough of a size that said orifice is elastomerically squeezed closed except under a predetermined pressure differential thereacross, to thereby prevent water entry to said housing, but temporarily open to allow hydrogen gas escape from said housing at a pressure differential across said septum;

said orifice having a diameter of about 0.020 to 0.060 inch.

10. The device in claim 9 wherein said orifice is of a diameter of about 0.050 inch.

* * * * *